US005541355A

United States Patent [19]

Kondo et al.

[11] Patent Number: 5,541,355

[45] Date of Patent: Jul. 30, 1996

[54] ELECTRONIC MUSICAL INSTRUMENT HAVING AN AUTOMATIC PEFORMANCE FUNCTION

[75] Inventors: Masao Kondo; Shinichi Ito, both of Hamamatsu, Japan

[73] Assignee: Yamaha Corporation, Japan

[21] Appl. No.: 452,506

[22] Filed: May 30, 1995

Related U.S. Application Data

[63] Continuation of Ser. No. 54,048, Apr. 27, 1993, abandoned.

[30] Foreign Application Priority Data

Apr. 28, 1992 [JP] Japan ..... 4-110454

[51] Int. Cl.[6] ..... G10H 1/38

[52] U.S. Cl. ..... 84/610; 84/634

[58] Field of Search ..... 84/609–613, 634–627, 84/DIG 12, DIG 22

[56] References Cited

U.S. PATENT DOCUMENTS

| | | | |
|---|---|---|---|
| 4,646,610 | 3/1987 | Sakurai et al. | 84/1.03 |
| 4,839,810 | 6/1989 | Abe | 364/419 |
| 5,164,531 | 11/1992 | Imaizumi et al. | 811/634 |
| 5,278,348 | 1/1994 | Eitaki et al. | 84/836 |
| 5,298,677 | 7/1994 | Shimada | 84/635 |

FOREIGN PATENT DOCUMENTS 3-9479 2/1991 Japan .

*Primary Examiner*—Vit N. Miska
*Attorney, Agent, or Firm*—Graham & James

[57] ABSTRACT

An electronic musical instrument has a memory device, a reading out device, a first tone generating device, a stop designating device, a terminating device, and a second tone generating device. The reading out device reads out automatic performance data from the memory device. The first tone generating device generates an automatic performance tone signal based on the read out automatic performance data. During the automatic performance, when a performer designates the stop of the automatic performance using the stop designating device, the terminating device terminates the reading out of the automatic performance data by the reading out device in response to the stop designation by the stop designating device. Accordingly, the first tone generating device stops the generation of the automatic performance tone signals, and the second tone generating device generates a percussion tone signal when the reading out of the automatic performance data is terminated in response to the stop designated by the stop designating device.

13 Claims, 10 Drawing Sheets

| TYPE \ ROOT | | 0 |
|---|---|---|
| | | 1 |
| 0 | MAJOR | -5 |
| | | -8 |
| | | OFF |
| | | OFF |
| 1 | MINOR | -5 |
| | | -9 |
| | | OFF |
| | | OFF |
| 2 | SEVENTH | -2 |
| | | -5 |
| | | -8 |
| | | OFF |
| 3 | MINOR SEVENTH | -2 |
| | | -5 |
| | | -9 |
| | | OFF |

ELECTRONIC MUSICAL INSTRUMENT HAVING AN AUTOMATIC PEFORMANCE FUNCTION

This is a continuation of application Ser. No. 08/054,048 filed on Apr. 27, 1993, now abandoned.

BACKGROUND OF THE INVENTION

1. Field of the Invention

The present invention relates to electronic musical instruments, and more particularly, to an electronic musical instrument having an automatic accompaniment function or an automatic performance function. The automatic performance includes an automatic accompaniment.

2. Background Art

In a conventional electronic musical instrument having an automatic accompaniment function or an automatic performance function, the following technique is used in order to terminate an automatic accompaniment or an automatic performance. When a performer operates a stop switch to designate the termination of the automatic accompaniment function or the automatic performance function, the automatic accompaniment or automatic performance is forced to terminate. Hereafter, this technique is referred to as technique (1). Furthermore, when the performer operates an ending switch to designate a transition from the currently performed automatic accompaniment or automatic performance to an ending pattern suitable for the musical style thereof, the ending pattern is performed. Then, when the ending pattern has been completed, the automatic accompaniment or the automatic performance ends. Hereafter, the above technique is referred to as technique (2).

In a conventional electronic musical instrument using technique (1), even if tile automatic accompaniment or the automatic performance is carried out using any pattern thereof, because the automatic accompaniment or the automatic performance is promptly terminated, the generated musical tones are unnatural and are not musically desirable.

In contrast, in a conventional electronic musical instrument using technique (2), the generated musical tone is natural and is musically preferable. However, the following drawbacks do exist. Since the ending switch is required in addition to the stop switch, the construction of a panel on which a variety of switches are arranged becomes complex, thereby increasing the cost of the system. Since a portion of memory is required for storing the ending patterns corresponding to a plurality of styles, the cost of the system is further increased. Moreover, because of these procedures (for example, the procedure for changing the pattern of the automatic accompaniment or the automatic performance into the ending pattern) a special procedure different from the regular stop procedure using the stop switch must be provided. Accordingly, an ending function cannot be provided in popular electronic musical instruments at a low cost.

SUMMARY OF THE INVENTION

In consideration of the above, it is an object of the present invention to provide an electronic musical instrument which is able to stop automatic accompaniment or automatic performance without musical incongruity and which is of simple construction.

To satisfy this object, the present invention provides an electronic musical instrument comprising a memory device for storing automatic performance data; a reading out device for reading out said automatic performance data from said memory device; a first tone generating device for generating automatic performance tone signals based on said automatic performance data read out by said reading out device; a stop designating device for designating the stop of an automatic performance of said automatic performance tone signals; a terminating device for terminating said reading out of said automatic performance data by said reading out device in response to said stop designated by said stop designating device; and a second tone generating device for generating a percussion tone signal when said reading out of said automatic performance data is terminated by said terminating device.

According to this construction, when the reading out device reads out the automatic performance data from the memory device, the first tone generating device generates automatic performance tone signals based on the read out automatic performance data. During the automatic performance, when the performer designates the stop of the automatic performance using the stop designating device, the terminating device terminates the reading out of the automatic performance data by tile reading out device in response to the stop designation by the stop designating device. Accordingly, the first tone generating device terminates the generation of the automatic performance tone signals, and the second tone generating device generates the percussion tone signal at the time when the reading out of the automatic performance data is terminated by the terminating device.

Furthermore, the present invention provides an electronic musical instrument comprising a memory device for storing automatic performance data; a chord designating device for designating a chord; a reading out device for reading out said automatic performance data from said memory device; a first tone generating device for generating automatic performance tone signals based on said automatic performance data read out by said reading out device; a stop designating device for designating the stop of an automatic performance of said automatic performance tone signals; a terminating device for terminating said reading out of said automatic performance data by said reading out device in response to said stop designated by said stop designating device; and a second tone generating device for generating a musical tone signal based on a chord designated by said chord designating device, during a predetermined period from the timing at which said reading out of said automatic performance data is terminated by said terminating device.

According to such a structure, when the reading out device reads out the automatic performance data from the memory device based on the designated chord, the first tone generating device generates automatic performance tone signals based on the read out automatic performance data. During the automatic performance, when the performer designates the stop of the automatic performance using the stop designating device, the terminating device terminates the reading out of the automatic performance data by the reading out device in response to the stop designation by the stop designating device. Accordingly, the first tone generating device terminates the generation of the automatic performance tone signals, and the second tone generating device generates a musical tone signal based on the designated chord by the chord designating device, during a predetermined period from the timing at which the reading out of the automatic performance data is terminated.

In addition, the present invention provides an electronic musical instrument comprising a memory device for storing automatic performance data; a reading out device for reading out said automatic performance data from said memory device; a tone generating device for generating a first tone signal based on said automatic performance data read out by said reading out device; a stop designating device for designating the stop of an automatic performance corresponding to said first tone signals; a terminating device for terminating said reading out of said automatic performance data by said reading out device in response to said stop designated by said stop designating device; and an end tone generating device for generating a predetermined end tone data when said reading out of said automatic performance data is terminated by said terminating device, wherein said tone generating device generates a second tone signal based on said end tone data.

According to such a structure, when the reading out device reads out the automatic performance data from the memory device, the tone generating device generates the first tone signals based on the read out automatic performance data. During the automatic performance, when the performer designates the stop of the automatic performance using the stop designating device, the terminating device terminates the reading out of the automatic performance data by the reading out device in response to the stop designation by the stop designating device. Accordingly, the tone generating device terminates the generation of the first tone signals, and the end tone generating device generates the predetermined end tone data when the reading out of the automatic performance data is terminated by the terminating device. Then, the tone generating device generates a second tone signal based on the end tone data.

According to the present invention, because the automatic performance or the automatic accompaniment is not abruptly terminated, there is a positive effect in that the musical tones are generated without musical incongruity. Moreover, because it is not necessary to provide an ending switch and to provide a portion of memory for storing the ending patterns, there is a positive effect in that the cost of the electronic musical instrument is lowered. In addition, since it is not necessary to provide a special procedure portion for conducting a procedure which differs from the regular stop procedure, there is a positive effect in that the procedure portion is simplified.

DETAILED DESCRIPTION OF THE PREFERRED EMBODIMENTS

Figure 1:
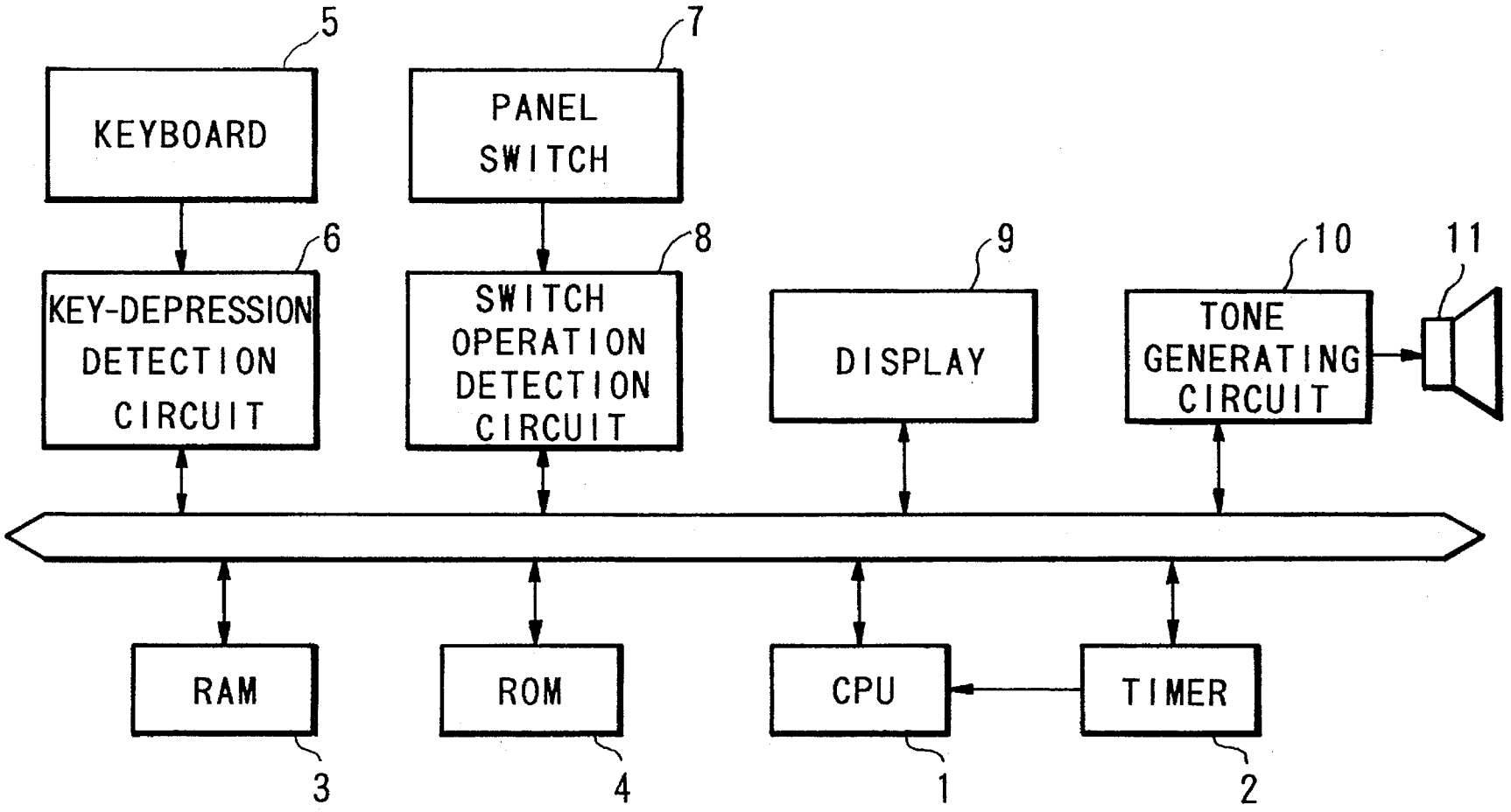
FIG. 1 shows a block diagram of the electrical structure of an electronic musical instrument according to the preferred embodiment of the present invention.

Hereinafter, an explanation of the preferred embodiments of the present invention is given with reference to the figures. FIG. 1 shows a block diagram of the electrical structure of an electronic musical instrument according to the preferred embodiment of the present invention. In this figure, a central processing unit (CPU) 1, which controls all apparatuses, and a timer 2, are provided. In the timer 2, the timing data is set by the CPU 1, and after each time that the time period designated by the timing data lapses, a timer interruption pulse is supplied to the CPU 1. In FIG. 1, a RAM 3 and a ROM 4 are provided. In the RAM 3, all types of registers, flags, and the like are prepared for use when the CPU 1 carries out any type of procedure. In the ROM 4, various control programs used in the CPU 1, and a note conversion table referred to when a note is converted into a new note in response to the chord designated by the performer, are stored. Additionally, in the ROM 4, automatic accompaniment data, a harmony table referred to when a chord constituent note, which is added to the chord, is decided based on a root ROOT and a type TYPE of the chord composing the automatic accompaniment data, and the like, are stored.

Figures 2, 3:
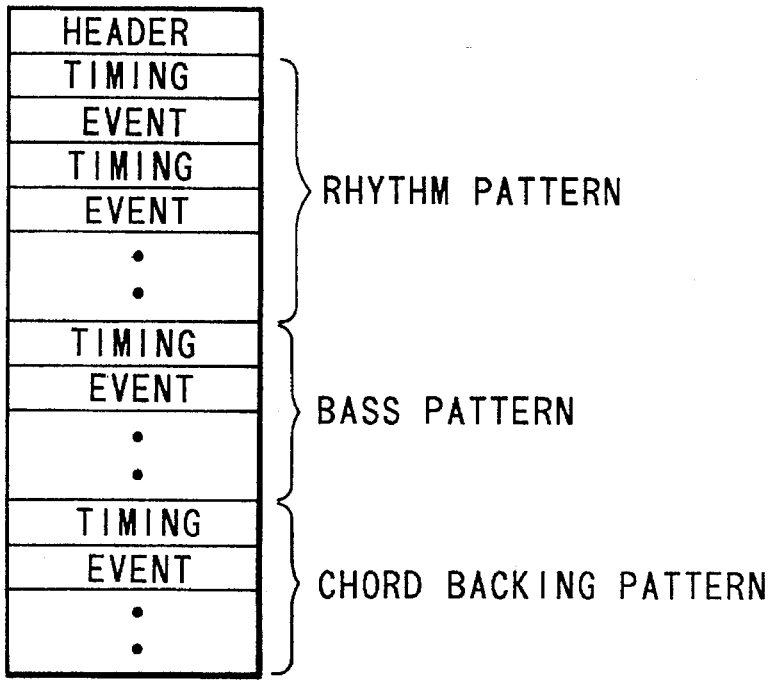
FIG. 2 shows an example of the format of automatic accompaniment data.
FIG. 3 shows an example of the structure of a harmony table.

In FIG. 2, an example of a format of the automatic accompaniment data is shown. The automatic accompaniment data are stored for every style, such as rock, waltz and the like, in the ROM 4. In a header, drum set data for setting the kind of drum corresponding to the above style, bass tone color data and chord backing tone color data concerning tone color of the bass and chord backing, respectively, are stored. Accordingly, in the header, sound production period data designating the sound production period (duration) of an end tone generated when the performance comes to an end, tone volume data, standard tone pitch data designating octaves used as a standard when the note is converted into a new note, and the like, are stored.

The sound production period data is data of the various sound production periods from an eighth note to a whole note, and is expressed by the clock number. Each of the rhythm pattern, the bass pattern, and the chord backing pattern is data corresponding to the period of a bar. A timing and an event in a group is data corresponding to a note. The timing signifies a time interval from the head of the bar (the clock number from the head of the bar) as the event is being generated. The event consists of data, such as note number, velocity, gate time, and the like. Additionally, in the case where the automatic accompaniment data is composed of only the rhythm pattern, the event consists of the note number corresponding to the number representing a musical instrument and the velocity corresponding to the magnitude of the rhythm. Moreover, in the case where the electronic musical instrument according to the preferred embodiment of the present invention is used as a chord sequencer, the event is preferred to consist of data representing a chord.

FIG. 3 shows an example of the structure of the harmony table. In the harmony table, each of the chord constituent notes for each chord type is stored in the form of the number of a semitone apart from a note as a standard (a root). The reason why this harmony table is constituted as described above will be described below. In the event of the chord backing pattern of the automatic accompaniment data as shown in FIG. 2, all of the tones are not stored as the chord backing tone; only data such as the note number, the velocity, the gate time, and so on, designating the note C is stored with the desired rhythm. Then the CPU 1 regards the note C as the standard note and refers to the harmony table as shown in FIG. 3 to decide the chord constituent note based on the root and the type of the chord. For example, in the case where the note D is designated as the root and the major is designated as the type, the CPU 1 initially shifts the note C to the note D based on the above root and then decides the note D, the note A that is 5 semitones lower than the note D, and the note F# that is 8 semitones lower than the note D as the chord constituent note, while referring to the top of the harmony table as shown in FIG. 3.

Figure 4:
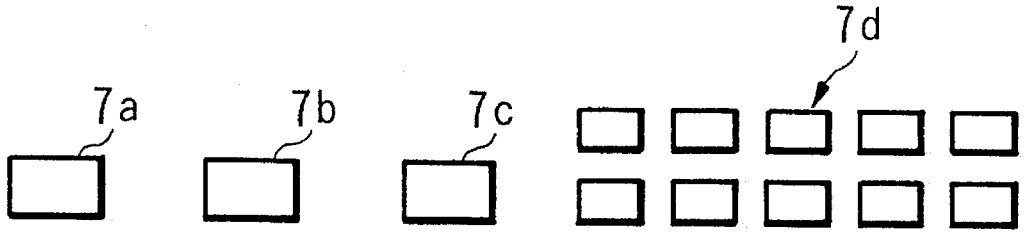
FIG. 4 shows an example of the structure of a part of the panel switch 7.

Additionally, as shown in FIG. 1, there are provided a keyboard 5 made up of a plurality of keys, and a key-depression detection circuit 6 which detects the operation of the keys of the keyboard 5, and outputs the key information corresponding to the keys depressed. Furthermore, in FIG. 1, a panel switch 7 is provided. As shown in FIG. 4, the panel switch 7 comprises an ABC switch 7*a*, a start switch 7*b*, a stop switch 7*c*, a plurality of styles switch 7*d* and so on. The ABC switch 7*a* is used for selecting the automatic accompaniment by the auto bass chord (hereinafter referred to as ABC) while in the ON state, and for selecting automatic accompaniment by only the rhythm while in the OFF state. The start switch 7*b* and the stop switch 7*c* are used for starting and stopping the automatic accompaniment, respectively. The plurality of style switches 7*d* is used for selecting the above styles.

A switch operation detection circuit 8 is provided which detects the operation of each switch of the panel switch 7, and outputs the operation information corresponding to each respective switch. In addition, there are provided a display 9 comprising, for example, a liquid crystal display or the like; a tone generating circuit 10 which outputs a musical tone signal under the control of the CPU 1; and a sound system 11 comprising an amplifier, speaker, and the like, which inputs the musical tone signal supplied from the tone generating circuit 10 and generates a musical tone.

Next the flow of the procedures of the CPU 1 will be described with reference to the flow charts in FIGS. 5 through 14. Hereinafter, 1 beat is equal to 24 counts of the number of counts CLK of a clock managing the tempo of the automatic accompaniment.

Figure 5:
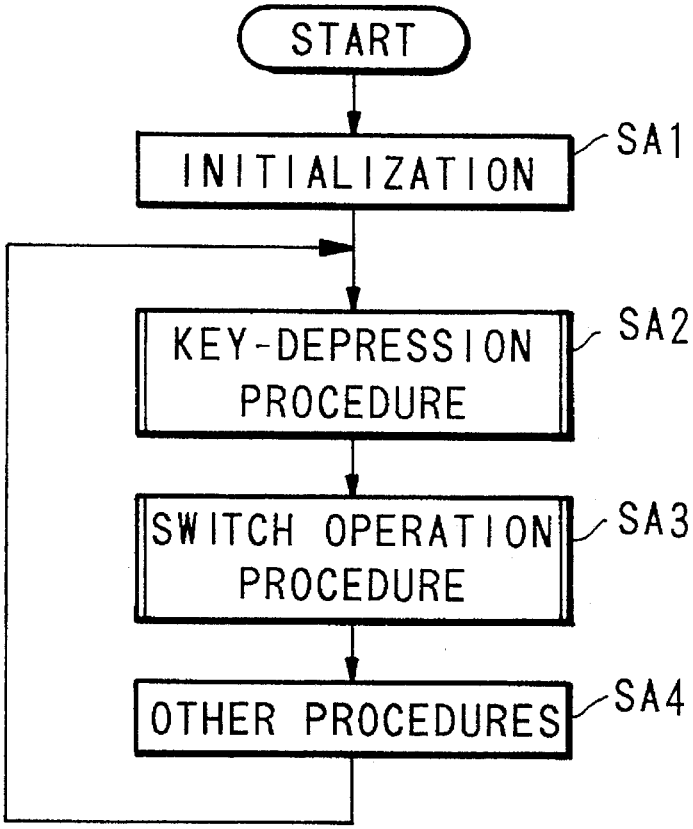
FIG. 5 is a flow chart showing the main procedure routine of the CPU 1.

When power is supplied to the electronic musical instrument shown in FIG. 1, the CPU 1 begins to execute the main procedure routine shown in FIG. 5 starting with step SA1. In step SA1, the initialization of all apparatuses is carried out. This initialization consists of the setting of the initial tone color in the tone generating circuit 10, and the clearing of the register of RAM 3, and so on. Next, in step SA2, the key-depression procedure preformed when at least one of the keys on the keyboard 5 is depressed or released, is carried out. The details of this key-depression procedure will be described below. Next, when the key-depression procedure has been carried out, the routine proceeds to step SA3.

In step SA3, the switch operation procedure preformed when at least one of the switches on the panel switch 7 is operated, is carried out. The details of this switch operation procedure will be described below. Next, when the switch operation procedures have been carried out, the routine proceeds to step SA4. In step SA4, procedures other than those mentioned above are carried out. Next, when other procedures have been carried out, the routine returns to step SA2 and steps SA2 through SA4 are repeatedly carried out until the power is turned off. As stated above, in the main procedure routine, the CPU 1 operates to designate the synthesis of the musical tone to other portions, and this synthesis of the musical tone will be realized by diverse procedures described below.

Figure 6:
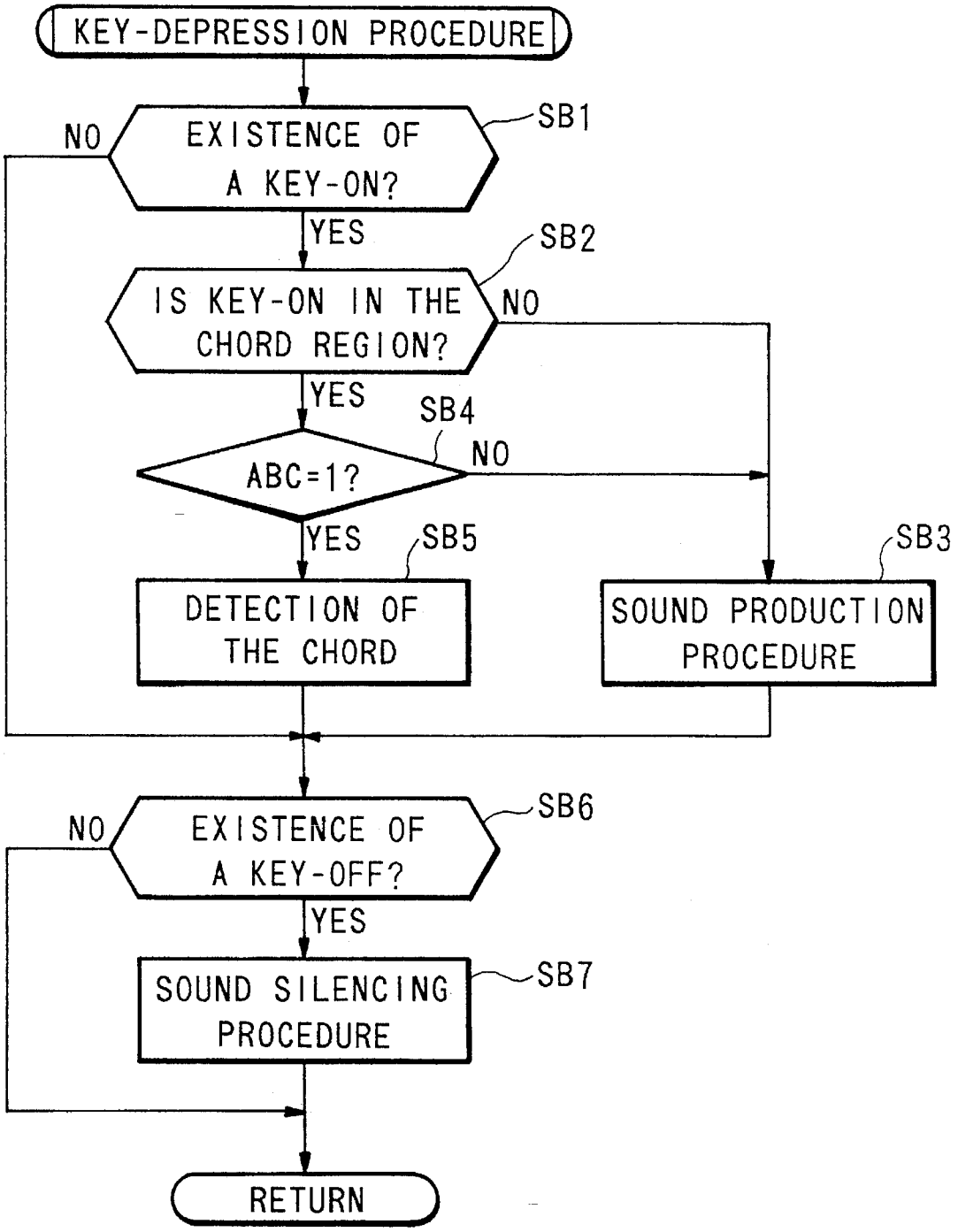
FIG. 6 is a flow chart showing a key-depression procedure routine of the CPU 1.

Next, the key-depression procedure of the CPU 1 will be described with reference to the flow chart in FIG. 6. When the routine proceeds to step SA2 shown in FIG. 5, the CPU 1 begins to execute the key-depression procedure routine shown in FIG. 6 starting with step SB1. In step SB1, judgment is made as to whether or not there a key-on exists. When the result of the judgment in SB1 is [NO], that is, when the key-on does not exist, the routine proceeds to step SB6 without carrying out the key-on procedure outlined in SB2 through SB5 below.

In contrast, when the result of the Judgment in step SB1 is [YES], in other words, when the key-on does exist, the routine proceeds to step SB2. In step SB2, judgment is made as to whether or not the above key-on is one of the key-ons corresponding to the keys in the chord region of the keyboard 5. When the result of the judgement in SB2 is [NO], namely, when the above key-on is one of the key-ons corresponding to the keys in the normal key region of the keyboard 5, in order to sound a musical tone, the routine proceeds to step SB3. In step SB3, the sound production procedure is carried out. Since this sound production procedure is well-known, an explanation of the procedure will be omitted here. When this sound production procedure has been carried out, the routine proceeds to step SB6.

In contrast, when the result of the judgment in step SB2 is [YES], that is, when the above key-on is one of the key-ons corresponding to the keys in the chord region of the keyboard 5, the routine proceeds to step SB4. In step SB4, judgment is made as to whether or not an auto bass chord flag ABC has been set to [1]. This flag ABC, is set to [1] when the performer turns on ABC switch 7*a* (see FIG. 4), one of the panel switches 7 to select the automatic accompaniment by the ABC, and is cleared to [0] when the performer turns off ABC switch 7*a* to select the automatic accompaniment by only the rhythm. When the result of judgment in step SB4 is [NO], the routine proceeds to step SB3. After the above sound production procedure is carried out in step SB3, the routine proceeds to step SB6.

In contrast, when the result of the judgment in step SB4 is [YES], namely, when the flag ABC has been set to [1], the routine proceeds to step SB5. In step SB5, the root ROOT and the type TYPE of the chord designated by the performer are detected based on the key depressed. These root ROOT and type TYPE of the chord are held until the next chord is designated by the performer.

In step SB6, judgment is made as to whether or not there a key-off exists. When the result of the judgment in SB6 is [NO], in other words, when the key-off does not exist, the routine returns to the main procedure routine in FIG. 5 without other procedures and proceeds to step SA3.

On the other hand, when the result of the judgment in step SB6 is [YES], namely, when the key-off exists, the routine proceeds to step SB7. In step SB7, a sound silencing procedure is carried out. Since this sound silencing procedure is well-known, an explanation of the procedure will be omitted. When this sound silencing procedure has been carried out, the routine returns to the main routine in FIG. 5 and proceeds to step SA3.

Figure 7:
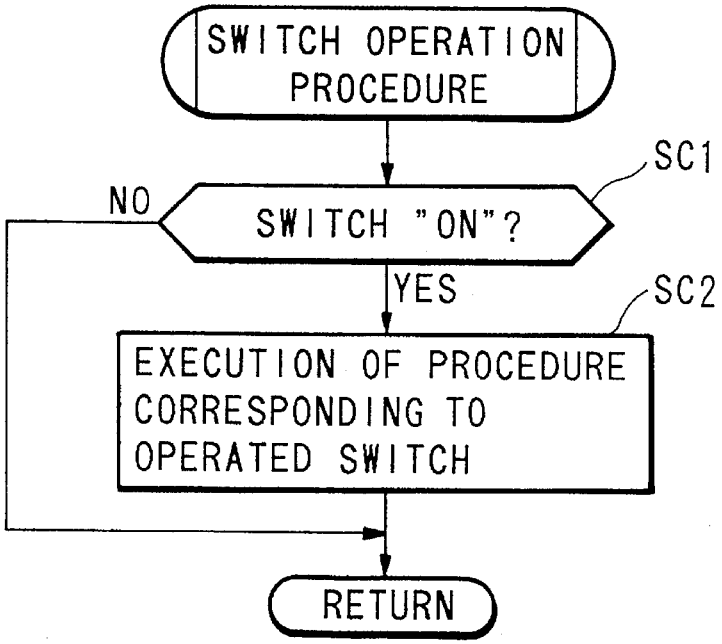
FIG. 7 is a flow chart showing a switch operation procedure routine of the CPU 1.

Next, the switch operation procedure of the CPU 1 will be described with reference to the flow chart in FIG. 7. When the routine proceeds to step SA3 shown in FIG. 5, the CPU 1 begins to execute the switch operation procedure routine shown in FIG. 7 starting with step SC1. In step SC1, judgment is made as to whether or not at least one of the switches on the panel switch 7 is operated. When the result of the Judgment in step SC1 is [NO], the routine returns to the main routine in FIG. 5 without other procedures and proceeds to step SA4.

On the other hand, when the result of the judgment in step SC1 is [YES], namely, when at least one of the switches on the panel switch 7 is operated, the routine proceeds to step SC2. In step SC2, the following switch procedure corresponding to the operated switch is carried out, then the routine returns to the main routine in FIG. 5 and proceeds to step SA4.

Figure 8:
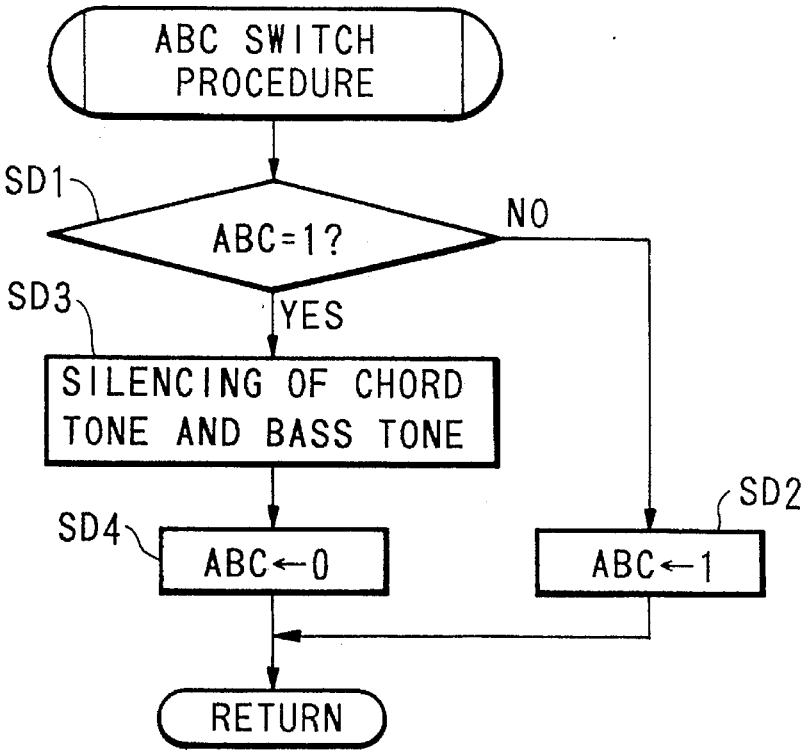
FIG. 8 is a flow chart showing an ABC switch operation procedure routine of the CPU 1.

Next, the ABC switch operation procedure of the CPU 1 will be described with reference to the flow chart in FIG. 8. When the performer operates the ABC switch 7*a* (see FIG. 4), the CPU 1 begins to execute the ABC switch procedure routine shown in FIG. 8 starting with step SD1. In step SD1, judgment is made as to whether or not the flag ABC has been set to [1]. When the result of the judgment in step SD1 is [NO], that is, when the flag ABC is cleared to [0], the routine proceeds to step SD2. In step SD2, the flag ABC is set to [1], the routine returns to the main routine in FIG. 5 via the switch operation procedure routine in FIG. 7 and proceeds to step SA4.

In contrast, when the result of the judgment in step SD1 is [YES], in other words, when the flag ABC is set to [1], the routine proceeds to step SD3. In step SD3, the chord backing tone and the bass tone are silenced to switch to the automatic performance by only the rhythm tone. In step SD4, the flag ABC is cleared to [0], the routine returns to the main routine in FIG. 5 via the switch operation procedure routine in FIG. 7 and proceeds to step SA4.

Figure 9:
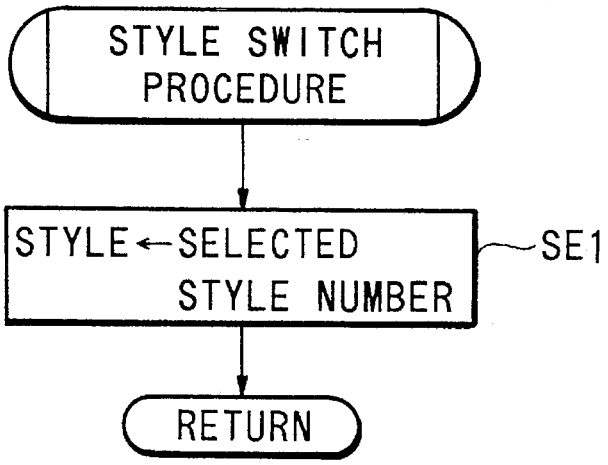
FIG. 9 is a flow chart showing a style switch operation procedure routine of the CPU 1.

Next, the style switch operation procedure of the CPU 1 will be described with reference to the flow chart in FIG. 9. When the performer operates one of the style switches 7*c* (see FIG. 4), the CPU 1 begins to execute the style switch procedure routine shown in FIG. 9 starting with step SE1. In step SE1, the style number selected by the performer is stored in a register STYLE, the routine returns to the main routine in FIG. 5 via the switch operation procedure routine in FIG. 7 and proceeds to step SA4.

Figure 10:
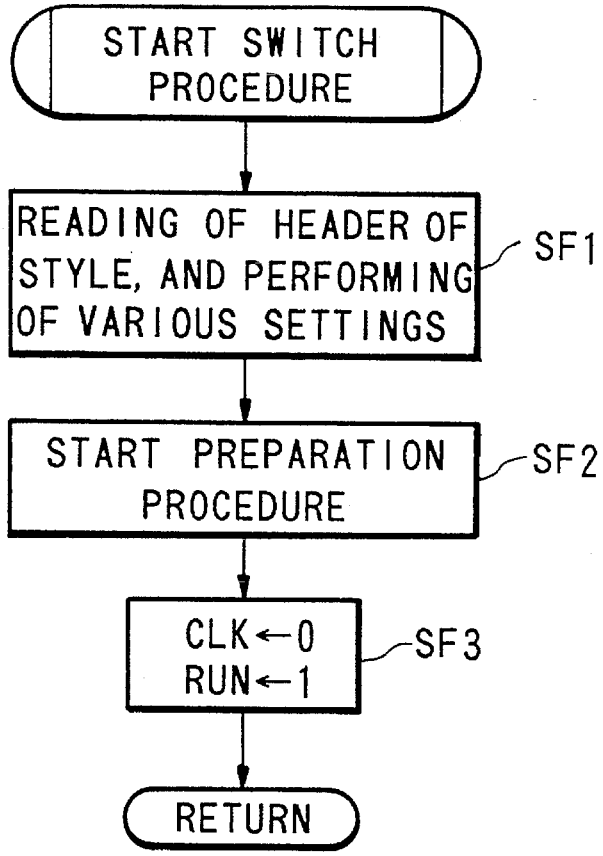
FIG. 10 is a flow chart showing a start switch operation procedure routine of the CPU 1.

Next, the start switch operation procedure of the CPU 1 will be described with reference to the flow chart in FIG. 10. When the performer operates the start switch 7*b* (see FIG. 4), the CPU 1 begins to execute the start switch procedure routine shown in FIG. 10 starting with step SF1. In step SF1, the header (see FIG. 2) is read out from the automatic accompaniment data in the ROM 4, which corresponds to the style number stored in the register STYLE by step SE1 of the above-mentioned style switch operation procedure routine, and various setting are carried out based on the read out header. In step SF2, a start preparation procedure is carried out to start the automatic accompaniment. This procedure is, for example, one in which an address pointer is stored in each head address of the rhythm pattern, the bass pattern, and the chord backing pattern, and head timing data is stored in a timing register to be compared with a clock when each pattern is read out. When this start preparation procedure has been carried out, the routine proceeds to step SF3. In step SF3, a register CLK is cleared to [0], which the clock is stored, "1" is added to the value at each interruption of the timer in the interruption procedure as described below, and a run flag RUN is set to [1], which is set to [1] during the performing of the automatic accompaniment. Then, the routine returns to the main routine in FIG. 5 via the switch operation procedure routine in FIG. 7 and proceeds to step SA4.

Figure 11:
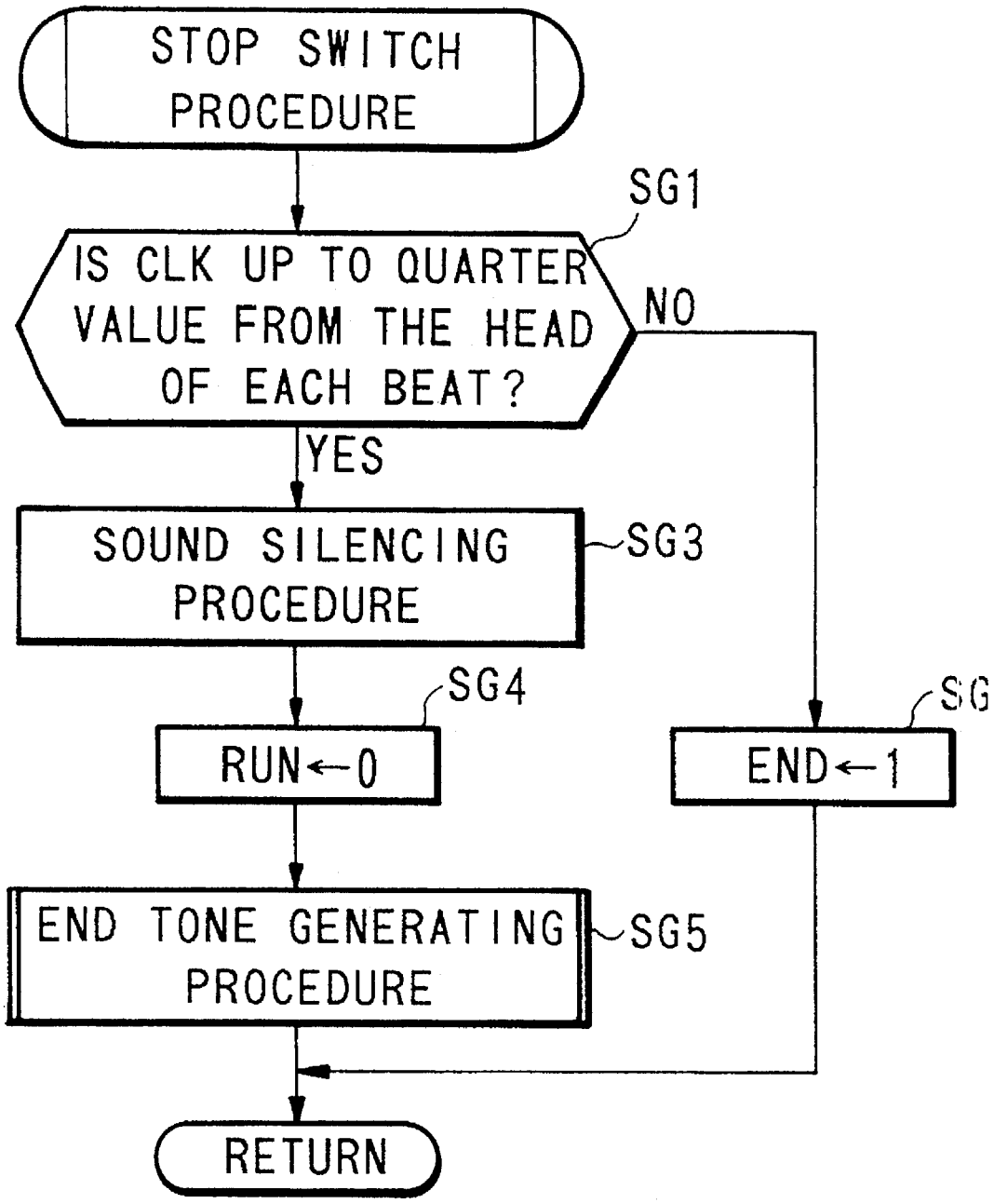
FIG. 11 is a flow chart showing a stop switch operation procedure routine of the CPU 1.

Next, the stop switch operation procedure of the CPU 1 will be described with reference to the flow chart in FIG. 11. When the performer operates the stop switch 7*c* (see FIG. 4), the CPU 1 begins to execute the stop switch procedure routine shown in FIG. 11 starting with step SG1. In step SG1, judgment is made as to whether or not the value stored in the register CLK is up to a quarter value from the head of each beat, namely, up to 6 counts. When the result of the judgment in step SG1 is [NO], the routine proceeds to step SG2. In step SG2, an end flag END is set to [1], which is set to [1] when an end tone generating procedure as described below is carried out and the automatic accompaniment is stopped at the timing of the next beat. Then, the routine returns to the main routine In FIG. 5 via the switch operation procedure routine in FIG. 7 and proceeds to step SA4.

On the other hand, when the result of the judgment in step SG1 is [YES], that is, when the value stored in the register CLK is up to a quarter value from the head of each beat, the routine proceeds to step SG3. In step SG3, the judgment that the performer had wanted to operate the stop switch 7*c* at the timing of each beat, is proceeded, and thereby the above-mentioned sound silencing procedure is carried out. In this embodiment, the automatic accompaniment is basically stopped at the timing of each beat. However, only in the case where the value stored in the register CLK is up to a quarter value from the head of each beat, is the automatic accompaniment abruptly terminated regardless of the timing of the beat, to conform to the intention of the performer.

Figure 12:
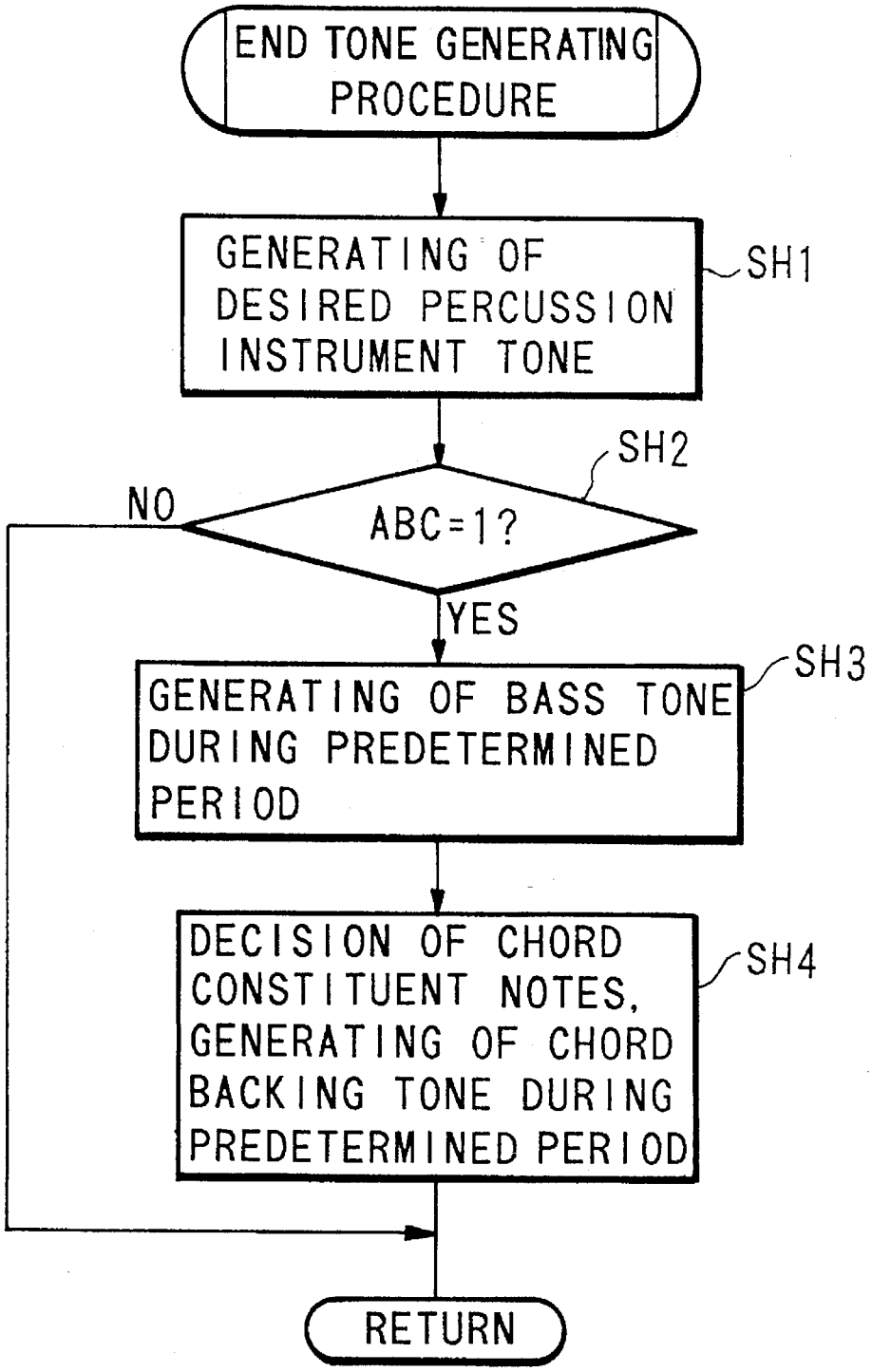
FIG. 12 is a flow chart showing an end tone generation procedure routine of the CPU 1.

In step SG4, the run flag RUN is cleared to [0]. Next, in step SG5, an end tone generating procedure is carried out. The routine of this procedure is shown in FIG. 12. In this routine, in step SH1, each of the desired percussion tones, for example, a bass drum tone and a cymbal tone, assigned to drum sets 1 and 2 stored in the header of the automatic accompaniment data shown in FIG. 2, which is common to all styles, is generated by one tone respectively at the same time.

In step SH2, judgment is made as to whether or not the flag ABC is set to [1]. When the result of the judgment in step SH2 is [NO], in other words, when tile flag ABC is cleared to [0], the routine returns to the main routine in FIG. 5 without other procedures via the stop switch procedure routine in FIG. 11 and the switch operation procedure routine in FIG. 7, and proceeds to step SA4.

In contrast, when the result of the judgment in step SH2 is [YES], namely when the flag ABC is set to [1], the routine proceeds to step SH3. In step SH3, the bass tone is generated during the predetermined period (the sound production period) based on the root ROOT of the chord designated just before the stop switch 7*c* is operated, and various data, such as the bass tone color data, the sound production period data, the tone volume data, the standard tone pitch data, and the like, are stored in the header of the automatic accompaniment data shown in FIG. 2. In step SH4, the chord constituent notes are decided based on the root ROOT and type TYPE of the chord designated, just before the stop switch 7*c* is operated, by referring to the harmony table shown in FIG. 3. Furthermore, the chord backing tone is generated during the predetermined period (the sound production period) based on various data, such as the chord backing tone color data, the sound production period data, the tone volume data, the standard tone pitch data, and the like, stored in the header of the automatic accompaniment data shown in FIG. 2. Then the routine returns to the main routine in FIG. 5 via the stop switch procedure routine in FIG. 11 and the switch operation procedure routine in FIG. 7, and then proceeds to step SA4. As described above, when the flag ABC is cleared to [0], the desired percussion tone is generated; in contrast, when the flag ABC is set to [1], the bass tone and the chord backing tone, as well as the percussion tone are generated at the desired period. Accordingly, the automatic accompaniment may be terminated without musical incongruity.

Figure 13:
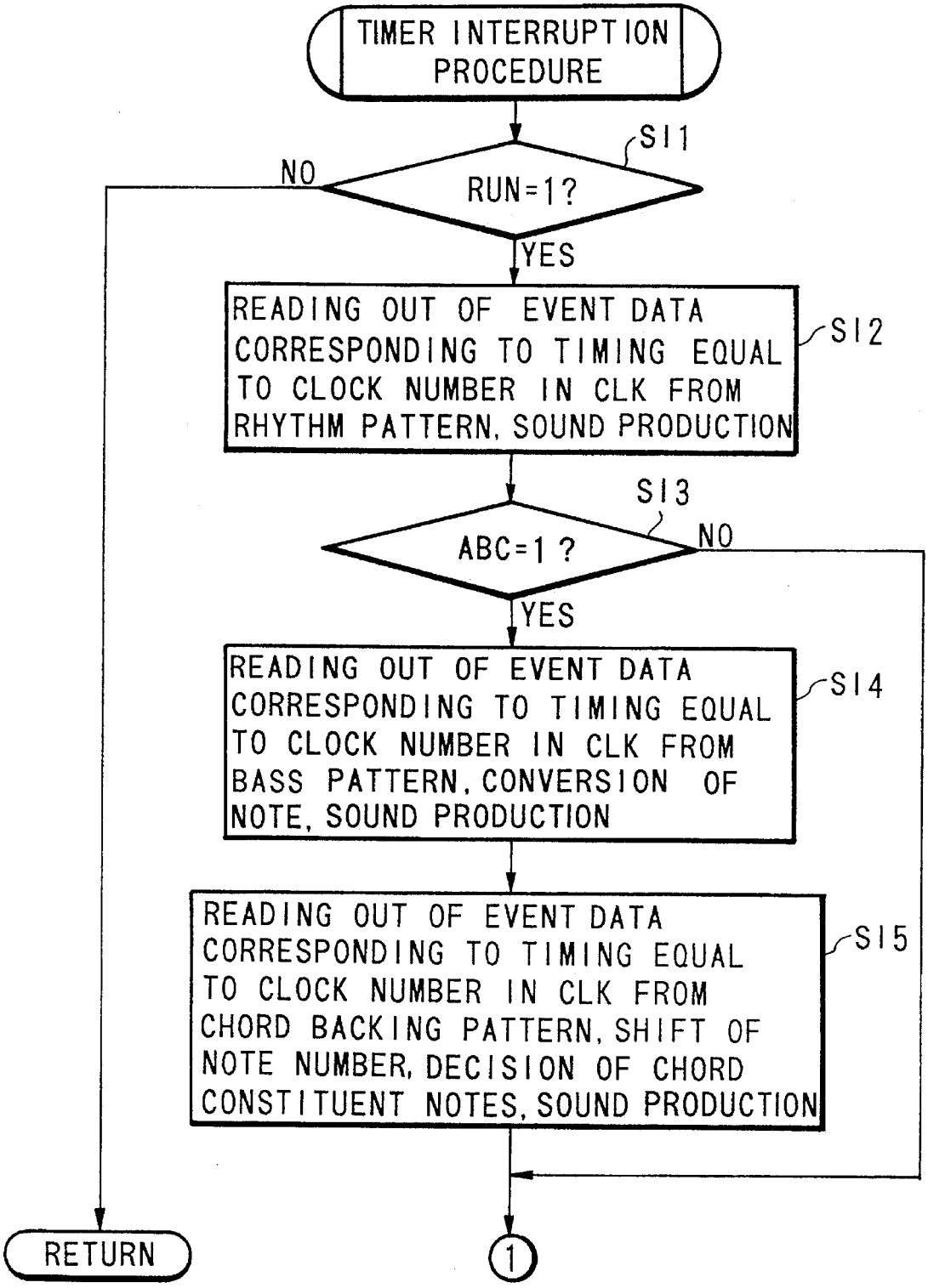
FIGS. 13 and 14 are flow charts showing a timer interruption procedure routine of the CPU 1.
Figure 14:
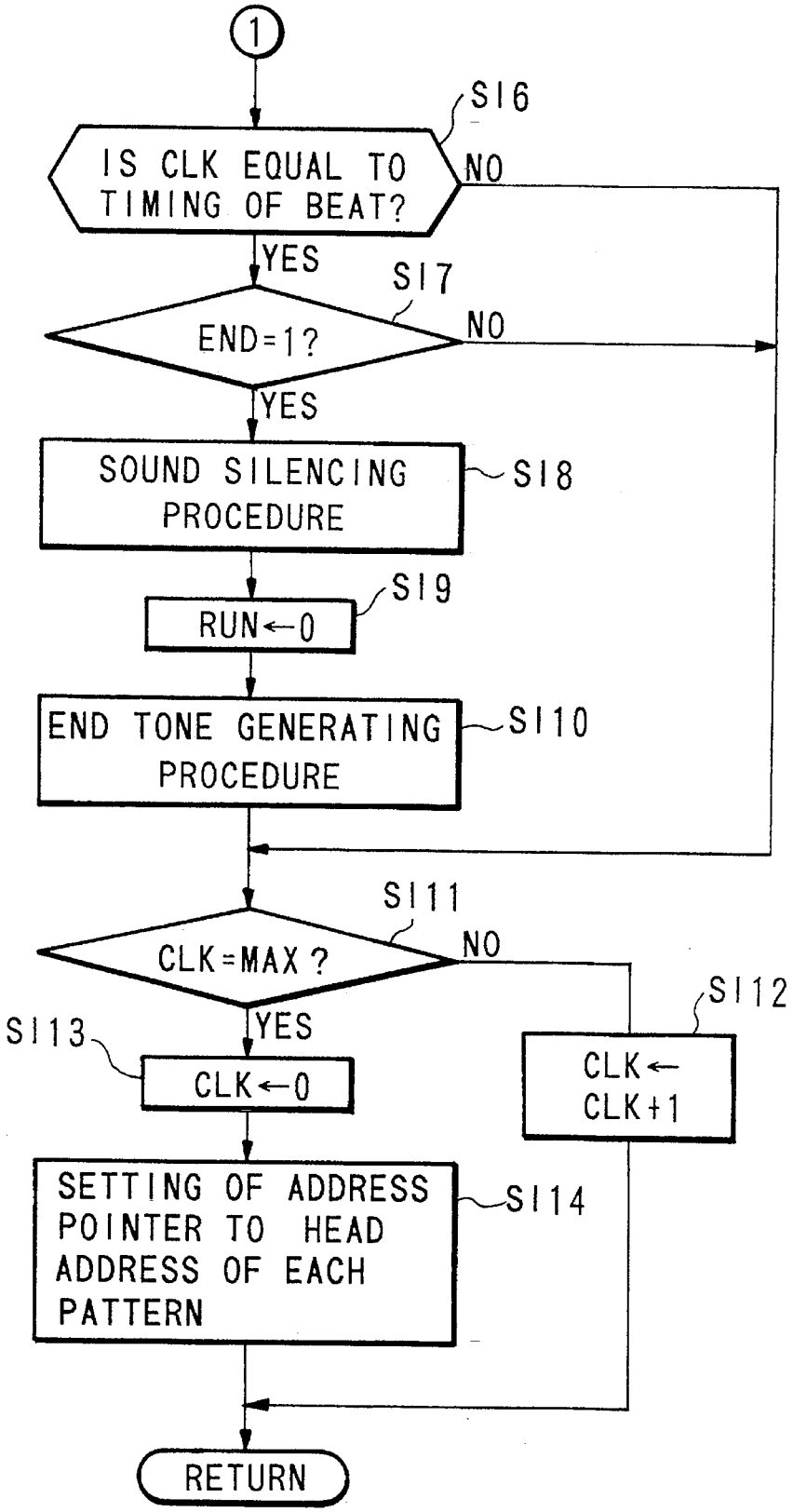

Next, the timer interruption procedure of the CPU 1, which is carried out at the constant period, will be described with reference to the flow chart in FIGS. 13 and 14. After the elapse of the constant period, the CPU 1 begins to execute the timer interruption procedure routine shown in FIGS. 13 and 14 starting with step SI1. In step SI1, judgment is made as to whether or not the run flag RUN is set to [1]. When the result of the judgment in step SI1 is [NO], the routine returns to the main procedure routine shown in FIG. 5 without other procedures.

In contrast, when tile result of the Judgment in step SI1 is [YES], in other words, when the run flag RUN is set to [1], the routine proceeds to step SI2. In step SI2, the event data corresponding to the timing equal to the clock number stored in register CLK is read out from the rhythm pattern shown in FIG. 2 and the sound production is carried out based on the read event data. In step SI3, Judgment is made as to whether or not the flag ABC is set to [1], that is, whether or not the ABC switch 7*a* is turned on by the performer to select the automatic accompaniment by the ABC. When the result of the judgment in step SI3 is [NO], namely, when the ABC switch 7*a* is not turned on by the performer, so that the automatic accompaniment by only the rhythm is selected, the routine proceeds to step SI6 shown in FIG. 14 without the carrying out of the procedure outlined in steps SI4 and SI5 below.

On the other hand, when the result of the Judgment in step SI3, is [YES], in other words, the flag ABC is set to [1], the routine proceeds to step SI4. In step SI4, the event data corresponding to the timing equal to the clock number stored in register CLK is read out from the bass pattern shown in FIG. 2. Furthermore, in step SI4, a note is converted to a new note by referring to the note conversion table, based on the root ROOT and type TYPE of the chord designated using the chord key region of the keyboard 5 by the performer, and the sound is produced based on the converted note. In step SI5, the event data corresponding to the timing equal to the clock number stored in register CLK is read out from the chord backing pattern shown in FIG. 2. Furthermore, in step SIS, the note number of the read out event data is shifted based on the above-mentioned root ROOT, the chord constituent notes is decided based on the type TYPE by referring to the harmony table shown in FIG. 3, and the sound is produced based on the chord constituent notes.

In step SI6, judgment is made as to whether or not the clock number stored in the register CLK, is equal to the timing of the beat, namely, whether or not the clock number is equal to a multiple of 24. The reason why this judgment is carried out will be described below. In the above-mentioned stop switch procedure routine, in the case where the timing of the performer operating the stop switch 7*c* shown in FIG. 4, is not up to a quarter value from the head of each beat, the end flag END is set to [1] and the end tone generating procedure is carried out at the timing of the next beat. Accordingly, the beat timing should be under constant watch. When the result of the judgment in step SI6 is [NO], the routine proceeds to step SI11 without carrying out the procedure outlined in steps SI7 through SI10 below.

In contrast, when the result of the judgment in step SI6 is [YES], that is, when the clock number stored in the register CLK is equal to the timing of the beat, the routine proceeds to step SI7.

In step SI7, judgment is made as to whether or not the flag END is set to [1], in other words, whether or not the execution of the end tone generating procedure at the timing of the next beat is planned. When the result of the judgment in step SI7 is [NO], that is, when the flag END is cleared to [0], the routine proceeds to step SI11 below.

On the other hand, when the result of the judgment in step SI7 is [YES], namely, when the flag END is set to [1], the routine proceeds to step SI8. In step SI8, the above-mentioned sound procedure is carried out. Next, in step SI9, the flag RUN is cleared to [0]. In step SI10, the above-mentioned end tone generating procedure is carried out. Next, in step SI11, judgment is made as to whether or not the clock number stored in the register CLK is equal to the maximum value pre-stored in a register MAX, for example, the value Corresponding to one bar: 96 counts in 4 beats. When the result of the judgment in step SI11 is [NO], the routine proceeds to step SI12. In step SI12, "1" is added to the value stored in the register CLK and the routine returns to the main procedure routine.

In contrast, when the result; of the judgment in step SI11 is [YES], namely, when the clock number stored in the register CLK is equal to the maximum value pre-stored in a register MAX, the routine proceeds to step SI13. In step SI13, the register CLK is cleared to [0]. In step SI14, the procedure by which address pointers are set to the head address of each pattern of the automatic performance data, is carried out, and the routine returns to the main procedure routine.

Furthermore, in the above-mentioned embodiment, the example is given in which, in an electronic musical instrument having an automatic accompaniment function, automatic accompaniment is carried out; however, the present invention is not limited thereto. It is also possible to apply the present invention, when the performance of the automatic performance is over in a normal sequencer, or when a performance is over in an apparatus carrying out a demonstration performance. In these apparatuses, in the case where the above-mentioned end tone generating procedure is carried out, for example, it is preferable not to generate the bass tone or the chord backing tone, but to generate only the drum tone.

Moreover, in the above-mentioned embodiment, an example is given in which the performer designates the chord when the chord backing tone and the bass tone are generated, using the key board 5; however, the present invention is not just limited thereto. It is also possible to designate the chord by a chord sequencer which reads out chords from a memory in which the chords are stored in an order designated by the performer, in the order in which the chords are stored in the memory and generates the read out chords.

In addition, in the above-mentioned embodiment, an example is given in which a switch which only turns on and off is used as the stop switch 7*c*; however, the present invention is not limited thereto. It is also possible that a touch detecting type switch is used as the stop switch 7*c*, and the tone volume, the tone color, or the chord constituent note of the end tone is controlled in response to the intensity of depression of the switch by the performer.

Moreover, in the above-mentioned embodiment, an example is given in which the bass tone and the chord backing tone of the end tone are generated based on the chord performed just before the performer designated the end of the automatic accompaniment using the stop switch 7c; however, the present invention is not limited thereto. It is also possible that, for example, in the case where the chord is changed by the performer while generating the end tone, the bass tone and the chord backing tone of the end tone are promptly generated based on the changed chord.

What is claimed is:

1. An electronic musical instrument comprising:

memory means for storing automatic performance data including a header portion and automatic performance pattern data representing at least one automatic performance pattern, wherein said header portion includes drum set data and duration; data reading out means for reading out said automatic performance pattern data from said memory means;

first tone generating means for generating automatic performance tone signals based on said automatic performance pattern data read out by said reading out means, the generated automatic performance tone signals corresponding to an automatic performance pattern;

stop designating means for designating the stop of an automatic performance of said automatic performance tone signals;

terminating means for terminating said reading out of said automatic performance pattern data by said reading out means in response to said stop designated by said stop designating means; and second tone generating means for generating a percussion tone signal in accordance with said drum set data as an ending tone signal when said reading out of said automatic performance pattern data is terminated by said terminating means, wherein said percussion tone signal is generated for a predetermined time designated by said duration data.

2. An electronic musical instrument according to claim 1 wherein said terminating means immediately terminates said reading out of said automatic performance pattern data by said reading out means when said stop designating means designates said stop within a predetermined period from the head of each beat, and terminates said reading out of said automatic performance pattern data by said reading out means at the head of the next beat when said stop designating means designates said stop after the predetermined period from the head of each beat.

3. An electronic musical instrument according to claim 1 wherein said stop designating means has a stop switch which is used to forcibly terminate said reading out of said automatic performance pattern data.

4. An electronic musical instrument according to claim 1 wherein said percussion tone signal corresponds to one of a bass drum tone and a cymbal tone.

5. An electronic musical instrument comprising:

memory means for storing automatic performance data including a header portion and automatic performance pattern data representing at least one automatic performance pattern, wherein said header portion includes tone color data and duration data;

chord designating means for designating a chord;

reading out means for reading out said automatic performance pattern data from said memory means;

first tone generating means for generating automatic performance tone signals based on said automatic performance pattern data read out by said reading out means, the generated automatic performance tone signals corresponding to an automatic performance pattern;

stop designating means for designating the stop of an automatic performance of said automatic performance tone signals;

terminating means for terminating said reading out of said automatic performance pattern data by said reading out means in response to said stop designated by said stop designating means; and second tone generating means for generating a musical tone signal based on a chord designated by said chord designating means and in accordance with said tone color data when said reading out of said automatic performance pattern data is terminated by said terminating means, wherein said musical tone signal is generated for a predetermined time designated by said duration data in said header.

6. An electronic musical instrument according to claim 5 wherein said terminating means immediately terminates said reading out of said automatic performance pattern data by said reading out means when said stop designating means designates said stop within a predetermined period from the head of each beat, and terminates said reading out of said automatic performance pattern data by said reading out means at the head of the next beat when said stop designating means designates said stop after the predetermined period from the head of each beat.

7. An electronic musical instrument according to claim 5 wherein said stop designating means has a stop switch which is used to forcibly stop said reading out of said automatic performance pattern data.

8. An electronic musical instrument according to claim 5 wherein said musical tone signal includes a bass tone signal.

9. An electronic musical instrument according to claim 5 wherein said musical tone signal includes a chord backing tone signal.

10. An electronic musical instrument according to claim 5 wherein said chord designating means includes chord designating members to be operated by a performer.

11. An electronic musical instrument according to claim 10 further comprising chord information memory means which previously stores chord information, wherein said chord designating means designates a chord by reading out said stored chord information.

12. An electronic musical instrument according to claim 5 wherein said automatic performance pattern data includes a plurality of automatic performance styles, said instrument further comprises selecting means which selects one of said plurality of automatic performance styles, and said reading out means reads out automatic performance pattern data corresponding to said selected automatic performance style, wherein at least one of a generation period, a tone color, a tone volume, and a tone pitch of said musical tone signal generated by said second tone generating means is decided based on said selected automatic performance style.

13. An electronic musical instrument according to claim 5 wherein said second tone generating means is provided with a harmony table in which chord constituent notes to be generated are stored in each type of chord, and said second tone generating means generates chord constituent tone signals corresponding to said notes based on said harmony table.

* * * * *